US011723393B2

(12) United States Patent
Duc

(10) Patent No.: US 11,723,393 B2
(45) Date of Patent: Aug. 15, 2023

(54) AEROSOL-GENERATING ARTICLE WITH AN INSULATED HEAT SOURCE

(71) Applicant: Philip Morris Products S.A., Neuchatel (CH)

(72) Inventor: Fabien Duc, Carouge (CH)

(73) Assignee: Philip Morris Products S.A., Neuchatel (CH)

( * ) Notice: Subject to any disclaimer, the term of this patent is extended or adjusted under 35 U.S.C. 154(b) by 488 days.

(21) Appl. No.: 16/305,137

(22) PCT Filed: May 31, 2017

(86) PCT No.: PCT/EP2017/063233
§ 371 (c)(1),
(2) Date: Nov. 28, 2018

(87) PCT Pub. No.: WO2017/207673
PCT Pub. Date: Dec. 7, 2017

(65) Prior Publication Data

US 2020/0323259 A1 Oct. 15, 2020

(30) Foreign Application Priority Data

May 31, 2016 (EP) ..... 16172329

(51) Int. Cl.
*A24B 15/16* (2020.01)
*A24D 1/22* (2020.01)
(Continued)

(52) U.S. Cl.
CPC ..... *A24B 15/165* (2013.01); *A24C 5/01* (2020.01); *A24D 1/02* (2013.01); *A24D 1/22* (2020.01)

(58) Field of Classification Search
None
See application file for complete search history.

(56) References Cited

U.S. PATENT DOCUMENTS 4,793,365 A 12/1988 Sensabaugh, Jr. et al.
5,040,551 A 8/1991 Schlatter et al.
(Continued)

FOREIGN PATENT DOCUMENTS

CN 86105536 A 2/1987
CN 1040496 A 3/1990
(Continued)

OTHER PUBLICATIONS

Combined Russian Office Action and Search Report dated Jul. 23, 2020 in Russian Patent Application No. 2018145020 (with English translation), 15 pages.
(Continued)

*Primary Examiner* — Michael J Felton
(74) *Attorney, Agent, or Firm* — Oblon, McClelland, Maier & Neustadt, L.L.P.

(57) ABSTRACT

An aerosol-generating article is provided, including an aerosol-forming substrate; a combustible heat source; at least one layer of ceramic paper circumscribing at least a portion of a length of the combustible heat source; one or more airflow pathways along which air may be drawn through the aerosol-generating article for inhalation; and one or more non-combustible, substantially air impermeable barriers between the combustible heat source and the aerosol forming substrate.

16 Claims, 3 Drawing Sheets

(51) Int. Cl.
*A24C 5/01* (2020.01)
*A24D 1/02* (2006.01)

(56) References Cited

U.S. PATENT DOCUMENTS

| | | | | |
|---|---|---|---|---|
| 5,159,940 | A | 11/1992 | Hayward et al. | |
| 2008/0166937 | A1* | 7/2008 | Garvey | E04B 1/941 442/1 |
| 2008/0233294 | A1 | 9/2008 | Lobovsky et al. | |
| 2011/0041861 | A1 | 2/2011 | Sebastian et al. | |
| 2012/0067360 | A1 | 3/2012 | Conner et al. | |
| 2013/0042865 | A1 | 2/2013 | Monsees et al. | |
| 2013/0133675 | A1 | 5/2013 | Shinozaki et al. | |
| 2013/0233329 | A1 | 9/2013 | Sebastian et al. | |
| 2015/0083150 | A1 | 3/2015 | Conner et al. | |
| 2015/0157052 | A1 | 6/2015 | Ademe et al. | |
| 2015/0216231 | A1 | 8/2015 | Roudier et al. | |
| 2015/0216232 | A1 | 8/2015 | Bless et al. | |
| 2015/0359259 | A1 | 12/2015 | Conner et al. | |
| 2016/0143355 | A1 | 5/2016 | Borges et al. | |
| 2016/0192704 | A1* | 7/2016 | Bonnely | A24D 1/22 131/329 |

FOREIGN PATENT DOCUMENTS

| | | | | |
|---|---|---|---|---|
| CN | 101778578 | A | 7/2010 | |
| CN | 102481021 | A | 5/2012 | |
| CN | 103037718 | A | 4/2013 | |
| CN | 103929989 | A | 7/2014 | |
| CN | 104219971 | A | 12/2014 | |
| CN | 104602554 | A | 5/2015 | |
| CN | 105324046 | A | 2/2016 | |
| CN | 105473013 | A | 4/2016 | |
| DE | 10 2011 053 601 | A1 | 3/2013 | |
| EP | 0 174 645 | A2 | 3/1986 | |
| EP | 0 174 675 | A1 | 3/1986 | |
| EP | 0 352 106 | A2 | 1/1990 | |
| JP | 3-19684 | A | 1/1991 | |
| JP | 3-114471 | A | 5/1991 | |
| JP | 8-507928 | A | 8/1996 | |
| JP | 2015-506709 | A | 3/2015 | |
| JP | 2015-527073 | A | 9/2015 | |
| SU | 1575929 | A3 | 6/1990 | |
| WO | WO 2012/014490 | A1 | 2/2012 | |
| WO | WO 2013/120855 | A1 | 8/2013 | |
| WO | WO 2014/037270 | A1 | 3/2014 | |
| WO | WO 2015/022320 | A2 | 2/2015 | |
| WO | WO-2015028654 | A1 * | 3/2015 | A24D 1/22 |
| WO | WO 2015/097005 | A1 | 7/2015 | |
| WO | WO 2015/101595 | A1 | 7/2015 | |
| WO | WO 2016/012769 | A1 | 1/2016 | |

OTHER PUBLICATIONS

International Search Report and Written Opinion dated Sep. 22, 2017 in PCT/EP2017/063233, filed May 31, 2017.

Combined Chinese Office Action and Search Report dated Jan. 6, 2021 in corresponding Chinese Patent Application No. 201780029105.1 (with English Translation), 17 pages.

Russian Office Action dated Oct. 29, 2020 in Patent Application No. 2018145020/03(075280) (with English translation), 16 pages.

Japanese Office Action dated Jun. 3, 2021 in Japanese Patent Application No. 2018-558702 (with English translation), 17 pages.

Combined Chinese Office Action and Search Report dated Apr. 2, 2022 in corresponding Chinese Patent Application No. 201780029105.1 (with English translation), 10 pages.

Office Action dated Sep. 14, 2022, in corresponding Japanese Patent Application No. 2022-008195 (with English Translation), 11 pages.

Korean Office Action dated Aug. 24, 2022 in Korean Patent Application No. 10-2018-7031421 (with English translation), 9 pages.

Korean Office Action dated Mar. 28, 2023 issued in Korean Patent Application No. 10-2018-7031421 filed May 31, 2017, with English translation.

* cited by examiner

AEROSOL-GENERATING ARTICLE WITH AN INSULATED HEAT SOURCE

The present invention relates to an aerosol-generating article comprising an aerosol-forming substrate and a combustible heat source, and a method for forming such an aerosol-generating article.

A number of aerosol-generating articles in which tobacco is heated rather than combusted have been proposed in the art. One aim of such 'heated' aerosol-generating articles is to reduce known harmful smoke constituents of the type produced by the combustion and pyrolytic degradation of tobacco in combustible cigarettes. In one known type of heated aerosol-generating article, an aerosol is generated by the transfer of heat from a combustible heat source to an aerosol-forming substrate located adjacent to the combustible heat source. During aerosol-generation, volatile compounds are released from the aerosol-forming substrate by heat transfer from the combustible heat source and entrained in air drawn through the aerosol-generating article. As the released compounds cool, they condense to form an aerosol that is inhaled by the user.

The combustion temperature of a combustible heat source for use in a heated aerosol-generating article should not be so high as to result in combustion or thermal degradation of the aerosol-forming substrate during use of the heated aerosol-generating article. However, the combustion temperature of the combustible heat source should be sufficiently high to generate enough heat to release sufficient volatile compounds from the aerosol-forming substrate to produce an acceptable aerosol, especially during early puffs.

A variety of combustible heat sources for use in heated aerosol-generating articles have been proposed in the art. The combustion temperature of combustible heat sources for use in heated aerosol-generating articles is typically between about 600° C. and 800° C.

It is known to wrap an insulating member around the periphery of a combustible heat source of a heated aerosol-generating article in order to reduce the surface temperature of the heated aerosol-generating article. However, it has been found that such insulating members can reduce the temperature of the combustible heat source during combustion of the combustible heat source, potentially reducing the effectiveness of the heat source in heating the aerosol-forming substrate to generate an aerosol. This effect is especially pronounced if an insulating member extends substantially the length of the combustible heat source. Such insulating members can also inhibit sustained combustion of the combustible heat source, such that the duration of combustion of the combustible heat source is reduced.

It would be desirable to provide an aerosol-generating article that has a reduced surface temperature proximate to the heat source, acceptable appearance, and that may be assembled in a straightforward and reliable manner. It would also be desirable to provide an aerosol-generating article that generates an acceptable aerosol during both early puffs and late puffs.

According to a first aspect of the invention, there is provided an aerosol-generating article comprising an aerosol-forming substrate, a combustible heat source and at least one layer of ceramic paper circumscribing at least part of the length of the combustible heat source. The article further comprises one or more airflow pathways along which air may be drawn through the aerosol-generating article for inhalation by a user, and one or more non-combustible, substantially air impermeable barriers between the combustible heat source and the aerosol forming substrate. The one or more non-combustible, substantially air impermeable barriers between the combustible heat source and the aerosol forming substrate isolate the combustible heat source from the one or more airflow pathways such that, in use, air drawn through the aerosol-generating article along the one or more airflow pathways does not directly contact the combustible heat source.

In use, the combustible heat source may be ignited by an external heat source, such as a lighter, and may begin to combust. The combusting heat source may heat the aerosol-forming substrate such that volatile compounds of the aerosol-forming substrate vaporise. When a user draws on the aerosol-generating article, air may be drawn into the aerosol-generating article along the one or more airflow pathways and mix with the vapour from the heated aerosol-forming substrate to form an aerosol. The aerosol may be drawn out of the aerosol-generating article and delivered to the user for inhalation by the user.

The at least one layer of ceramic paper circumscribing at least part of the length of the combustible heat source may insulate the combustible heat source. This may reduce the surface temperature of the aerosol-generating article at the combustible heat source. The at least one layer of ceramic paper may also allow sufficient air through the layer such that combustion of the combustible heat source may be substantially unimpeded.

As used herein, the term 'paper' is used to describe a thin mat or sheet of fibres. Typically, the papers described herein are manufactured from a pulp of fibres pressed into a thin sheet or mat. The paper of the present invention may comprise woven fibres. However, typically the paper of the present invention comprises non-woven fibres. The fibres of the paper of the present invention may be randomly interwoven. The papers described herein are generally thin. In other words, the thickness or depth of the mat or sheet of fibres is substantially less than the other dimensions of the mat or sheet, such as the length and width of the mat or sheet. Generally, the papers described herein are flexible. In other words, the papers described herein may be bent or shaped in order to be wrapped around the circumference of a combustible heat source, such that the paper circumscribes at least a portion of the combustible heat source.

As used herein, the term 'ceramic paper' is used to describe a paper comprising ceramic material. In other words, the term 'ceramic paper' is used to describe a thin mat or sheet of a fibrous material comprising ceramic material. As used herein, the terms 'ceramic paper' and 'ceramic fibre paper' are used interchangeably.

The ceramic paper of the present invention may be fibrous material comprising fibres of ceramic material. The ceramic paper may comprise woven fibres of ceramic material. The ceramic paper may comprise nonwoven fibres of ceramic material. The ceramic paper may comprise fibrous ceramic material comprising at least one of ceramic fibre batting, ceramic fibre wadding and ceramic fibre wool. In some embodiments, the ceramic paper may comprise fibres of ceramic material only. In other words, in some embodiments the ceramic paper may not comprise fibres of non-ceramic material.

The ceramic paper may comprise other forms of ceramic material, including particulate ceramic material. The ceramic paper may comprise more than one form of ceramic material, for example, fibrous ceramic material and particulate ceramic material.

The ceramic material may comprise any suitable ceramic material. The ceramic material may comprise crystalline ceramic materials. The ceramic material may comprise semi-crystalline ceramic materials. The ceramic material may comprise non-crystalline ceramic materials. The ceramic material may be amorphous. The ceramic material may be semi-crystalline. The ceramic material may be crystalline.

As used herein, the term 'ceramic material' encompasses glasses. As used herein, the term 'glass' is used to describe materials that exhibit a glass transition at a glass transition temperature. Typically, the term 'glass' is used herein to describe non-crystalline or amorphous solid materials. However, the term 'glass' also encompasses material comprising crystalline components and non-crystalline components. Glass materials comprising both crystalline and non-crystalline components may be referred to as 'glass-ceramic' materials.

The properties of the glass material of the present invention may be determined by the method of formation of the glass. As used herein, the term 'glass' encompasses glasses formed by any suitable method. Suitable methods of forming glasses include: melt quenching; physical vapour deposition; solid-state reactions, including thermochemical and mechanochemical reactions; liquid-state reactions, such as the sol-gel method; irradiation of crystalline solids, such as radiation amorphisation; and pressure amorphisation (i.e. formation under action of high pressure).

In some embodiments, the ceramic material may comprise a glass. The ceramic material may be a glass. The glass may be a glass-ceramic material. The ceramic paper may comprise glass fibres. The ceramic paper may comprise glass-ceramic fibres.

In some embodiments, the ceramic material may not comprise a glass. In other words, the ceramic material may comprise any ceramic materials other than glasses. The ceramic material may not be a glass material. The ceramic material may not comprise glass fibres. In these embodiments, the ceramic material typically comprises crystalline ceramic materials.

The ceramic material may comprise at least one of an oxide, a carbide, a boride, a nitride and a silicide. For example the ceramic material may comprise a metal oxide. The ceramic paper may comprise at least one of silica ($SiO_2$), calcium oxide (CaO), magnesium oxide (MgO), alumina ($Al_2O_3$) and zirconium dioxide ($ZrO_2$), all of which are understood to be ceramic materials. For example, the ceramic paper may comprise at least one of alkaline earth silicate wool, alumina silicate wool or polycrystalline wool. The ceramic paper may comprise at least one of iron oxide ($Fe_2O_3$), potassium oxide ($K_2O$), sodium oxide ($Na_2O$), all of which are understood to be ceramic materials.

The ceramic paper may comprise any suitable amount of fibrous material. The ceramic paper may comprise at least about 40 percent by weight ceramic material; at least about 50 percent by weight ceramic material; or at least about 60 percent by weight ceramic material. The ceramic paper may comprise about 100 percent by weight ceramic material; less than about 100 percent by weight ceramic material; less than about 90 percent by weight ceramic paper material; or less than about 80 percent by weight ceramic material. For example, the ceramic paper may comprise between about 50 percent by weight ceramic material and about 100 percent by weight ceramic material.

The ceramic paper may comprise non-fibrous material. The non-fibrous material may include water.

The ceramic paper may comprise non-ceramic material. The non-ceramic material may include a polymeric material. The non-ceramic material may include an organic material. The non-ceramic material may include an inorganic material. The non-ceramic material may include at least one binder material to hold the ceramic material together. The binder material may be any suitable binder material. The binder material may comprise one or more organic binders, such as bitums, animal and plant glues and polymers. The binder material may comprise one or more inorganic binder materials, such as lime, cement, gypsum and liquid glass Where the binder material comprises one or more polymers, the polymers may comprise: acrylic resin, phenolic resin, polyester, epoxy, polyether, PVOH, styrene based, polycarboxylic ether and polyurethane. The binder may comprise one or more of CMC and bentonite. The binder material may be an acrylic binder. The non-ceramic material may comprise one or more materials for reinforcing the ceramic paper. For example, the non-ceramic material may comprise polymer fibres, such as polyamides and polyimides.

The ceramic paper may be further reinforced by additional means, such as particulate reinforcement. For example, the ceramic paper may be reinforced with particles of carbon black. The ceramic paper may further include any other suitable constituents, including but not limited to titanium dioxide, aluminium trihydrate and pigments which may include iron and manganese.

The ceramic paper may comprise any suitable amount of non-ceramic material. In some embodiments, the ceramic paper may comprise ceramic material only. In other words, in some embodiments, the ceramic paper may not comprise any non-ceramic materials. The ceramic paper may comprise about 0 percent by weight non-ceramic material. The ceramic paper may comprise between 0 percent by weight non-ceramic material and about 25 percent by weight non-ceramic material. The ceramic paper may comprise: at least about 0.5 percent by weight non-ceramic material; at least about 2 percent by weight non-ceramic material; at least about 10 percent by weight non-ceramic material; or at least about 20 percent by weight non-ceramic material. The ceramic paper may comprise less than about 40 percent by weight non-ceramic material; less than about 30 percent by weight non-ceramic paper material; or less than about 15 percent by weight non-ceramic material.

In some embodiments where the at least one layer of ceramic paper comprises 100 percent by weight ceramic material, the ceramic paper does not comprise any additional materials, such as binders or reinforcement materials. Advantageously, providing ceramic paper without any additional materials may reduce the production of undesirable compounds on heating of the ceramic material during combustion of the combustible heat source, which may affect the experience of a user.

In some embodiments, the ceramic paper may comprise biosoluble fibres. As used herein, the term 'biosoluble' is used to describe a material that is soluble in a biological system, such as a biological system in the human body. The biosolubility of a material in a particular biological system may differ significantly from the solubility of the material in water. As used herein, a substance may be considered to be biosoluble if at least 0.1 g of that substance dissolves in 100 ml of the solvent of the biological system. Similarly, a substance may be considered to be bioinsoluble if less than 0.1 g of the material dissolves in 100 ml of the solvent of the biological system. Typically, a biosoluble fibre of the present invention is soluble in the respiratory system of a user on inhalation of the fibre. In other words, a biosoluble fibre of the present invention typically dissolves in the respiratory system of a user on inhalation of the fibre. Biosoluble fibres of the present invention may be soluble in the alveolar environment of a person.

The biosoluble material may be any suitable biosoluble material. Suitable biosoluble materials include alkaline earth silicate wools and high-alumina low-silica wools.

In some embodiments of the invention, the ceramic paper may comprise about 100 percent by weight alkaline-earth silicate wool.

In some embodiments of the invention, the ceramic paper may comprise: between about 50 percent by weight alkaline-earth silicate wool and about 100 percent by weight alkaline-earth silicate wool; between about 0 percent by weight binder, such as an acrylic binder, and about 15 percent by weight binder; and less than about 10 percent by weight inert inorganic material.

In some embodiments of the invention, the ceramic paper may comprise between about 60 percent by weight silica and about 70 percent by weight silica; between about 15 percent by weight calcium oxide and about 35 percent by weight calcium oxide; between about 4 percent by weight magnesium oxide and about 20 percent by weight magnesium oxide.

In some embodiments of the invention, the ceramic paper may comprise: less than about 40 percent by weight alumina; less that about 10 percent by weight organic material; and less than about 1 percent by weight moisture.

The compositions mentioned above refers to the percentage by weight of the various components after the ceramic paper has been fired.

Examples of suitable ceramic papers comprising biosoluble ceramic fibres that are commercially available include: Superwool® Fibre Paper, Superwool® Fibre Flex Wrap, Superwool® HT Fibre, Superwool® Plus Fibre and Superwool® Plus 332-E; all of which are available from Morgan Advanced Materials, plc. Other suitable ceramic papers include ceramic papers made from refractory ceramic fibres available from Ningbo Firewheel Thermal Insulation & Sealing Co., Ltd. Binder free ceramic papers may also be suitable, such as Rescor 300 BL from Final Advanced Materials, or the no-binder biosoluble fibre paper from DL-Thermal.

The ceramic paper may have a low thermal conductivity. In other words, the ceramic paper may be a good thermal insulator. For example, the ceramic paper may have a thermal conductivity of between about 0.5 to 2 W/mK at a temperature of about 23° C. This low thermal conductivity is observed particularly where the ceramic paper comprises woven or non-woven fibrous ceramic material. This may be due to the relatively open, highly porous structure of ceramic paper comprised of fibrous ceramic material, which reduces heat transfer by conduction.

The ceramic paper may have a high permeability to air. This may be due to the relatively open, highly porous structure. The at least one layer of ceramic paper may be sufficiently permeable to air to enable the combustible heat source to combust substantially unimpeded. For example, the at least one layer of ceramic paper may have a permeability to air of greater than about 4000 ($cm^3/(min*cm^2)$).

The at least one layer of ceramic paper circumscribes at least portion of the length of the combustible heat source. The at least one layer of ceramic paper of the present invention may circumscribe substantially the full length of the combustible heat source. This may enable the aerosol-generating article to benefit from the insulating properties of the ceramic paper, to reduce the surface temperature proximate to the heat source during use, and to benefit from the permeability to air of the ceramic paper, enabling sufficient ambient air to reach the combustible heat source for the combustible heat source to ignite and combust substantially unimpeded.

The at least one layer of ceramic paper may be isolated from the one or more airflow pathways such that, in use, air drawn through the aerosol-generating article along the one or more airflow pathways does not directly contact the at least one layer of ceramic paper.

In some embodiments the at least one layer of ceramic paper may be spaced from the one or more airflow pathways such that air drawn through the aerosol-generating article along the one or more airflow pathways does not directly contact the at least one layer of ceramic paper.

In some embodiments, one or more portions of the at least one layer of ceramic paper may be covered, coated or encapsulated in a material substantially impermeable to fibres and particles. The one or more portions of the at least one layer of ceramic paper that are covered, coated or encapsulated in a material substantially impermeable to fibres and particles may be located in proximity to air drawn through the aerosol-generating article along the one or more airflow pathways. The covering, coating or encapsulation may isolate air drawn through the aerosol-generating article along the one or more airflow pathways from the fibres and particles of the at least one layer of ceramic paper.

In some embodiments, one or more portions of the at least one layer ceramic paper may be covered in a layer of paper to isolate the at least one layer of ceramic paper from the one or more airflow pathways. The layer of paper may be provided on at least one of the inner surface of the at least one layer of ceramic paper and the outer surface of the at least one layer of ceramic paper. The layer of paper may be provided on both the inner and outer surfaces of the at least one layer of ceramic paper. The layer of paper may comprise laminated paper. The layer of paper may be co-laminated with the at least one layer ceramic paper. The layer of paper may be provided on only a portion of the at least one layer of ceramic paper that is adjacent the airflow pathways.

The at least one layer of ceramic paper may be substantially combustion resistant. As used herein, the term 'combustion-resistant' refers to a material that remains substantially intact during ignition and combustion of the combustible heat source. The provision of at least one layer of combustion resistant ceramic paper circumscribing at least a portion of the length of the combustible heat source may advantageously prevent flames or smoke being emitted from the layer. This may substantially prevent or inhibit undesirable emissions or odours being released from the layer during the combustion of the combustible heat source.

The ceramic paper may have advantageous mechanical properties. For example, the ceramic paper may be flexible and machinable due to the reinforcing effect of the ceramic material, in particular the ceramic fibres if they are present. The ceramic paper may have a machinability that facilitates formation of a layer of the ceramic paper circumscribing at least a portion of the length of the heat source.

As used herein, the term 'layer' is used to describe a body of material generally conforming to the shape of the combustible heat source. The at least one layer of ceramic paper may be any suitable type of layer arranged to circumscribe the heat source. Suitable types of layer include, amongst others, wrappers and coatings. As used herein, the term 'coating' is used to describe a layer of material that covers and is adhered to the heat source.

The at least one layer of ceramic paper may be in direct contact with the combustible heat source. The at least one layer of ceramic paper may be spaced apart from the combustible heat source.

The at least one layer of ceramic paper circumscribes at least a portion of the length of the combustible heat source. For example, the at least one layer of ceramic paper may circumscribe about half the length of the combustible heat source. The at least one layer of ceramic paper may circumscribe more than half the length of the combustible heat source. The at least one layer of ceramic paper may circumscribe between about 60 percent and about 100 percent of the length of the combustible heat source. The at least one layer of ceramic paper may circumscribe at least about 70 percent of the length of the combustible heat source. The at least one layer of ceramic paper may circumscribe at least about 80 percent of the length of the combustible heat source. The at least one layer of ceramic paper may circumscribe at least about 90 percent of the length of the combustible heat source. The at least one layer of ceramic paper may circumscribe substantially the length of the combustible heat source.

The at least one layer ceramic paper may circumscribe the entire length of the combustible heat source. As used herein, the term 'length' is used to describe the dimension of a component or a part of the aerosol-generating article in the longitudinal direction of the aerosol-generating article.

The at least one layer of ceramic paper may circumscribe about half the length of the aerosol-forming substrate. Advantageously, the at least one layer of ceramic paper circumscribing the aerosol-forming substrate may lower the surface temperature of the aerosol-generating article at the aerosol-forming substrate.

The at least one layer of ceramic paper may circumscribe the combustible heat source at a downstream end of the combustible heat source. This may advantageously reduce the surface temperature of the aerosol-generating article at the portion of the combustible heat source which is nearest to the user during normal operation of the aerosol-generating article.

The at least one layer of ceramic paper may circumscribe the combustible heat source at an upstream end of the combustible heat source.

The at least one layer of ceramic paper may circumscribe the combustible heat source at the upstream end and at the downstream end.

Uncovered portions of the combustible heat source may be referred to herein as 'naked' portions. The at least one layer of ceramic paper of the present invention may be provided to cover or circumscribe 'naked' or uncovered portions of the combustible heat source.

In some embodiments, a portion of the combustible heat source may be circumscribed by at least one additional layer at the upstream end. The at least one additional layer may be a layer of cigarette paper. In these embodiments, an upstream portion of the combustible heat source is a naked portion. In other words, an upstream portion of the combustible heat source is not covered by the at least one additional layer. In these embodiments, the at least one layer of ceramic paper may circumscribe the upstream portion of the combustible heat source. The at least one layer of ceramic paper may circumscribe the combustible heat source from the upstream end of the at least one additional layer circumscribing the upstream portion of the combustible heat source to at or around the downstream end of the combustible heat source. As such, in these embodiments the combustible heat source may be circumscribed substantially along its length by a combination of the at least one additional layer at the downstream end and the at least one layer of ceramic paper at the upstream end. In some embodiments, the at least one layer of ceramic paper and the at least one additional layer may overlap along the length of the combustible heat source.

The combustible heat source, the aerosol-forming substrate and the at least one layer of ceramic paper may be configured to substantially prevent or inhibit the temperature of the aerosol-forming substrate from exceeding about 375° C. during the combustion of the combustible heat source. For example, the combustible heat source, the aerosol-forming substrate and the at least one layer of ceramic paper may be shaped, dimensioned and arranged to substantially prevent or inhibit the temperature of the aerosol-forming substrate from exceeding about 375° C. during combustion of the combustible heat source. This may preserve the integrity of the aerosol-forming substrate. For example, if the aerosol-forming substrate comprises one or more aerosol-formers, the aerosol-formers may undergo pyrolysis above temperatures of about 375° C. At even higher temperatures, and where the aerosol-forming substrate comprises tobacco, for example, the tobacco may combust.

The combustible heat source, the aerosol-forming substrate and the at least one layer of ceramic paper may be configured such that during combustion of the combustible heat source the temperature of the aerosol-forming substrate at 2 mm from the proximal face of the aerosol-forming substrate is at least about 100° C. for a period of at least about 6 minutes.

The at least one layer of ceramic paper may have any suitable thickness. Generally, the at least one layer of ceramic paper is a thin layer. The thickness of the at least one layer of ceramic paper may be at least about 0.25 millimetres or at least about 0.5 millimetres. The thickness of the at least one layer of ceramic paper may be less than about 10 millimetres or less than about 5 millimetres. The at least one layer of ceramic paper may have a thickness of between about 0.25 millimetres and about 10 millimetres or between about 0.5 millimetres and about 5 millimetres.

The at least one layer of ceramic paper may further comprise one or more air inlets, such as one or more perforations. The one or more air inlets may further increase the permeability to air of the at least one layer of ceramic paper.

An aerosol-generating article according to the present invention comprises an aerosol-forming substrate. As used herein, the term 'aerosol-forming substrate' is used to describe a substrate capable of releasing volatile compounds upon heating, which can form an aerosol. The aerosols generated from aerosol-forming substrates of aerosol-generating articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be solid. The aerosol-forming substrate may be solid at room temperature.

The aerosol-forming substrate may comprise at least one aerosol-former and at least one material capable of emitting volatile compounds in response to heating.

The at least one aerosol-former may be any suitable known compound or mixture of compounds that, in use, facilitates formation of a dense and stable aerosol and that is substantially resistant to thermal degradation at the operating temperature of the aerosol-generating article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Exemplary aerosol-formers for use in aerosol-generating articles according to the invention are polyhydric alcohols or mixtures thereof, such as triethylene glycol, 1,3-butanediol and, glycerine.

The material capable of emitting volatile compounds in response to heating may be a charge of plant-based material, for example a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon. The plant based-material may comprise additives including, but not limited to, humectants, flavourants, binders and mixtures thereof. The plant-based material may consist of essentially of tobacco material, optionally homogenised tobacco material.

Aerosol-generating articles according to the invention may comprise aerosol-forming substrates comprising nicotine. For example, aerosol-generating articles according to the invention comprise aerosol-forming substrates comprising tobacco.

The aerosol-forming substrate may be circumscribed by a filter plug wrap.

An aerosol-generating articles according to the present invention comprises a combustible heat source arranged to heat the aerosol-forming substrate and isolated from the one or more airflow pathways.

The combustible heat source may comprise a body of combustible material. The body of combustible material may have a substantially constant diameter. The body of combustible material may have a constant diameter along its length. This advantageously may simplify the processes involved in manufacturing the combustible heat source and aerosol-generating article. In some embodiments, the body of combustible material may form a substantially circularly cylindrical body having a substantially constant diameter along its length.

The combustible heat source may be a carbonaceous heat source. As used herein, the term 'carbonaceous' is used to describe a combustible heat source comprising carbon. Preferably, combustible carbonaceous heat sources for use in aerosol-generating articles according to the invention have a carbon content of at least about 35 percent, more preferably of at least about 40 percent, most preferably of at least about 45 percent by dry weight of the 30 combustible heat source.

The combustible heat source according to the present invention may be a combustible carbon-based heat source. As used herein, the term 'carbon-based heat source' is used to describe a heat source comprised primarily of carbon.

Combustible carbon-based heat sources for use in aerosol-generating articles according to the invention may have a carbon content of at least about 50 percent, preferably of at least about 60 percent, more preferably of at least about 70 percent, most preferably of at least about 80 percent by dry weight of the combustible carbon-based heat source.

The combustible heat source of the present invention is isolated from the one or more airflow pathways through the aerosol-generating article. As used herein, the term 'airflow pathway' is used to describe a route along which air may be drawn through the aerosol-generating article for inhalation by a user. As used herein the terms 'upstream' and 'downstream' are used to describe relative directions and positions of components of the aerosol-generating article in relation to the direction air flows through the one or more airflow pathways when a user draws on the aerosol-generating article.

Isolation of the combustible heat source from the one or more airflow pathways of the aerosol-generating article may substantially prevent or inhibit activation of combustion of the combustible heat source during puffing by a user. This may substantially prevent or inhibit spikes in the temperature of the aerosol-forming substrate during puffing by a user. This may substantially prevent or inhibit combustion or pyrolysis of the aerosol-forming substrate under intense puffing regimes. This may substantially prevent or inhibit changes in the composition of the aerosol generated by the aerosol-generating article due to a user's puffing regime.

Isolation of the combustible heat source from the one or more airflow pathways may also substantially prevent or inhibit combustion and decomposition products, and other materials formed during ignition and combustion of the combustible heat source, from entering air drawn through the aerosol-generating article along the one or more airflow pathways.

The isolated combustible heat source of the present invention may comprise a blind heat source. As used herein, the term 'blind' is used to describe a combustible heat source in which air drawn through the aerosol-generating article for inhalation by a user does not pass through an airflow channel along the combustible heat source. As such, heat transfer between the blind combustible heat source and the aerosol-forming substrate occurs predominantly by conductive heat transfer.

By not providing airflow channels through the combustible heat source, convective heat transfer between the combustible heat source and the aerosol-forming substrate is reduced or minimised. Reducing convective heat transfer between the combustible heat source and the aerosol-forming substrate may substantially prevent or inhibit spikes in the temperature of the aerosol forming substrate during puffing by a user. This may substantially prevent or inhibit combustion or pyrolysis of the aerosol-forming substrate under intense puffing regimes. This may substantially prevent or inhibit changes in the composition of the aerosol generated by the aerosol-generating article due to a user's puffing regime. This may also substantially prevent or inhibit combustion and decomposition products, and other materials formed during ignition and combustion of the combustible heat source, from entering air drawn through the aerosol-generating article along the one or more airflow pathways.

The isolated combustible heat source of the present invention may comprise a non-blind heat source. As used herein, the term 'non-blind' is used to describe a heat source in which air drawn through the aerosol-generating article for inhalation by a user passes through one or more airflow channels along the heat source. As such, heat transfer between the non-blind combustible heat source and the aerosol-forming substrate may occur both by conductive heat transfer and by convective heat transfer along the one or more airflow channels.

As used herein, the term 'airflow channel' is used to describe a channel extending along the length of a combustible heat source through which air may be drawn downstream for inhalation by a user. As such, the aerosol-generating article of the present invention may not comprise one or more airflow channels.

The one or more non-combustible, substantially air impermeable barriers between the combustible heat source and the aerosol forming substrate may comprise a first barrier that abuts one or both of a proximal end of the combustible heat source and a distal end of the aerosol-forming substrate. The first barrier may facilitate isolation of the combustible heat source from the one or more airflow pathways of the aerosol-generating article. The first barrier may reduce the maximum temperature to which the aerosol-forming substrate is exposed during ignition or combustion of the combustible heat source, and may substantially prevent or inhibit thermal degradation or combustion of the aerosol-forming substrate during use of the aerosol-generating article.

As used herein, the term 'non-combustible' is used to describe a material that is substantially non-combustible at temperatures reached by the combustible heat source during combustion or ignition thereof.

As used herein, the term 'air impermeable' is used to describe a material that substantially prevents or inhibits the passage of air therethrough.

The first barrier may abut one or both of the proximal end of the combustible heat source and the distal end of the aerosol-forming substrate. The first barrier may be adhered or otherwise affixed to one or both of the proximal end of the combustible heat source and the distal end of the aerosol-forming substrate.

The first barrier may comprise a first barrier coating provided on a proximal face of the combustible heat source. In such embodiments, the first barrier may comprise a first barrier coating provided on at least substantially the entire proximal face of the combustible heat source.

The first barrier may comprise a first barrier coating provided on the entire proximal face of the combustible heat source. The first barrier coating may be formed and applied to the proximal face of the combustible heat source by any suitable method, such as the methods described in WO-A1-2013120855.

Depending upon the desired characteristics and performance of the aerosol-generating article, the first barrier may have a low thermal conductivity or a high thermal conductivity. In certain embodiments, the first barrier may have a thermal conductivity of between about 0.1 W/m.K and about 200 W/m.K.

The thickness of the first barrier may be suitably adjusted to achieve good aerosol-generating performance. In certain embodiments, the first barrier may have a thickness of between about 10 microns and about 500 microns.

The first barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Materials from which the first barrier may be formed include clays and glasses. More materials from which the first barrier may be formed include copper, aluminium, stainless steel, alloys, alumina ($Al_2O_3$), resins, and mineral glues.

Where the first barrier comprises a metal or an alloy, such as copper, aluminium, stainless steel, the first barrier coating may advantageously act as a thermal link between the combustible heat source and the aerosol-forming substrate. This may improve conductive heat transfer from the combustible heat source to the aerosol-forming substrate.

The aerosol-generating article may further comprise one or more air inlets downstream from a proximal end of the combustible heat source. In some embodiments, the one or more air inlets are between a proximal end of the combustible heat source and a proximal end of the aerosol-generating article. The one or more air inlets may be arranged such that air may be drawn into the one or more airflow pathways of the aerosol-generating article, though the one or more air inlets, without being drawn through the combustible heat source. This may substantially prevent or inhibit spikes in the temperature of the aerosol-forming substrate during puffing by a user.

The one or more air inlets may comprise any suitable air inlets through which air may be drawn into the aerosol-generating article. For example, suitable air inlets include holes, slits, slots or other apertures. The number, shape, size and arrangement of the air inlets may be suitably adjusted to achieve a good aerosol-generating performance.

The one or more air inlets may be arranged at the aerosol-forming substrate. The one or more air inlets may be arranged between a distal end of the aerosol-forming substrate and a proximal end of the aerosol-forming substrate. Where the one or more air inlets are arranged at the aerosol-forming substrate and the aerosol-forming substrate comprises a filter plug wrap, the filter plug wrap may be provided with one or more openings to allow air into the aerosol-forming substrate. The one or more openings may be slits, slots or other suitable apertures through which air may be drawn into the aerosol-forming substrate. The number, shape, size and arrangement of the openings may be suitably adjusted to achieve a good aerosol-generating performance.

The combustible heat source may comprise one or more airflow channels. In other words, the combustible heat source may be a non-blind heat source. The one or more airflow channels may extend along the length of the combustible heat source. The one or more airflow channels may form part of the one or more airflow pathways of the aerosol-generating article.

Where the combustible heat source comprises one or more airflow channels in the aerosol-generating article, the one or more non-combustible, substantially air impermeable barriers between the combustible heat source and the aerosol forming substrate may further comprise a second barrier between the combustible heat source and the one or more airflow channels of the combustible heat source.

The second barrier may facilitate isolation of the combustible heat source from the one or more airflow pathways of the aerosol-generating article. The second barrier may reduce the maximum temperature to which the aerosol-forming substrate is exposed during ignition or combustion of the combustible heat source, and so help to avoid or reduce thermal degradation or combustion of the aerosol-forming substrate during use of the aerosol-generating article.

The second barrier may be adhered or otherwise affixed to the combustible heat source.

The second barrier may comprise a second barrier coating provided on an inner surface of the one or more airflow channels. The second barrier may comprise a second barrier coating provided on at least substantially the entire inner surface of the one or more airflow channels. The second barrier may comprise a second barrier coating provided on the entire inner surface of the one or more airflow channels.

The second barrier coating may be provided by insertion of a liner into the one or more airflow channels. For example, where the one or more airflow pathways comprise one or more airflow channels that extend through the interior of the combustible heat source, a non-combustible, substantially air impermeable hollow tube may be inserted into each of the one or more airflow channels.

The second barrier may advantageously substantially prevent or inhibit combustion and decomposition products formed during ignition and combustion of the combustible heat source of aerosol-generating articles according to the invention from entering air drawn downstream along the one or more airflow channels.

Depending upon the desired characteristics and performance of the aerosol-generating article, the second barrier may have a low thermal conductivity or a high thermal conductivity. The second barrier may have a low thermal conductivity.

The thickness of the second barrier may be suitably adjusted to achieve good aerosol-generating performance. In certain embodiments, the second barrier may have a thickness of between about 30 microns and about 200 microns. In an embodiment, the second barrier has a thickness of between about 30 microns and about 100 microns.

The second barrier may be formed from one or more suitable materials that are substantially thermally stable and non-combustible at temperatures achieved by the combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Materials from which the second barrier may be formed include clays, glasses, aluminium, iron oxide and combinations thereof. If desired, catalytic ingredients, such as ingredients that promote the oxidation of carbon monoxide to carbon dioxide, may be incorporated in the second barrier. Suitable catalytic ingredients include, but are not limited to, for example, platinum, palladium, transition metals and their oxides.

Where aerosol-generating articles according to the invention comprise a first barrier between a downstream end of the combustible heat source and an upstream end of the aerosol-forming substrate and a second barrier between the combustible heat source and one or more airflow channels along the combustible heat source, the second barrier may be formed from the same or different material or materials as the first barrier.

Where the second barrier comprises a second barrier coating provided on an inner surface of the one or more airflow channels, the second barrier coating may be applied to the inner surface of the one or more airflow channels by any suitable method, such as the methods described in U.S. Pat. No. 5,040,551 and WO-A1-2013120855.

The aerosol-generating article may further comprise one or more additional layers circumscribing at least a proximal portion of the combustible heat source and a distal portion of the aerosol-forming substrate. The one or more additional layers may comprise at least one of: a heat-conducting element to transfer heat from the combustible heat source to the aerosol-forming substrate; and a layer of cigarette paper.

The heat-conducting element may circumscribe only a distal portion of the aerosol-forming substrate. The heat-conducting element may circumscribe substantially the length of the aerosol-forming substrate. The heat-conducting element may be in direct contact with at least one of the combustible heat source and the aerosol-forming substrate. The heat-conducting element may not be in direct contact with either of the combustible heat source and the aerosol-forming substrate.

The heat-conducting element may provide a thermal link between the combustible heat source and the aerosol-forming substrate. The heat-conducting element may be substantially combustion-resistant.

Suitable heat-conducting elements may include: metal foil wrappers or metal alloy foil wrappers. The metal foil wrappers may include: aluminium foil wrappers, steel foil wrappers, iron foil wrappers and copper foil wrappers. The heat-conducting element may comprise a tube of aluminium.

The proximal portion of the combustible heat source circumscribed by the heat-conducting element may be between about 2 millimetres and about 8 millimetres in length or between about 3 millimetres and about 5 millimetres in length.

The distal portion of the combustible heat source not surrounded by the heat-conducting element may be between about 4 millimetres and about 15 millimetres in length or between about 4 millimetres and about 8 millimetres in length.

The layer of cigarette paper may circumscribe at least a proximal portion of the combustible heat source, the length of aerosol-forming substrate and any other components of the aerosol-generating article arranged proximal to the aerosol-forming substrate. The layer of cigarette paper may circumscribe substantially the length of the combustible heat source. Where the layer of cigarette paper circumscribes substantially the length of the combustible heat source, the layer of cigarette paper may be provided with ventilation, such as perforations, holes or slits, at the combustible heat source to enable air to pass through the layer of cigarette paper to the combustible heat source. The number, shape, size and location of the openings may be suitably adjusted to achieve a good aerosol-generating performance. The layer of cigarette paper may be tightly wrapped around the combustible heat source and the aerosol-forming substrate such that the layer of cigarette paper grips and secures the combustible heat source and the aerosol-forming substrate when the aerosol-generating article is assembled.

The at least one layer of ceramic paper may be a radially outer layer. Where the aerosol-generating article comprises one or more additional layers, the radially outer layer of ceramic paper may overly at least a portion of the one or more additional layers. In other words, the one or more additional layers may be arranged between the combustible heat source and the at least one layer of ceramic paper. For example, where the aerosol-generating article comprises an additional layer comprising a heat conducting element, the heat conducting element may be a radially inner layer and the at least one layer of ceramic paper may be a radially outer layer, circumscribing at least a portion of the heat conducting element.

As used herein, the terms 'radially outer' and 'radially inner' are used to indicate the relative distances of components of the aerosol-generating article from the longitudinal axis of the aerosol-generating article. As used herein, the term 'radial' is used to describe the direction perpendicular to the longitudinal axis of the aerosol-generating article that extends in the direction between the proximal end and the distal end of the aerosol-generating article.

The one or more additional layers may be radially outer layers. The one or more additional layers may overlay at least a portion of the at least one layer of ceramic paper.

The at least one layer of ceramic paper may be secured or attached to one or more other components or parts of the aerosol-generating article. The at least one layer of ceramic paper may be secured to any suitable component of the aerosol-generating article. For example, the at least one layer of ceramic paper may be secured to at least one of the combustible heat source, the aerosol-forming substrate and the one or more additional layers. The at least one layer of ceramic paper may be secured to one or more components of the aerosol-generating article by any suitable means. The at least one layer of ceramic paper may be secured using an adhesive. Suitable adhesives may exhibit high temperature resistance, such as silicate glue. Where the one or more additional layers are radially outer layers, the one or more additional layers may be tightly wrapped around at least a portion of the at least one layer of ceramic paper.

In some embodiments, the at least one layer of ceramic paper may be integral with the combustible heat source. As used herein the term 'integral' is used to describe a layer that is in direct contact with the combustible heat source and attached to the combustible heat source without the aid of an extrinsic adhesive or other intermediate connecting material.

In some embodiments, the at least one layer of ceramic paper may be formed from a strip of ceramic paper having opposing ends. The strip of ceramic paper may be wrapped around the combustible heat source such that the opposing ends of the strip overlap. The overlapping opposing ends of the strip may be secured together using an adhesive or any other suitable means. This may secure the at least one layer of ceramic paper on the combustible heat source.

In some embodiments, an intermediate layer may be provided between the at least one layer of ceramic paper and at least one of the combustible heat source, the aerosol-forming substrate and the one or more additional layers. The intermediate layer may be adjacent to the at least one layer of ceramic paper. The intermediate layer may be in contact with the at least one layer of ceramic paper. The intermediate layer may be arranged radially inward of the at least one layer of ceramic paper.

The intermediate layer may be an adhesive layer. The adhesive layer may comprise any suitable adhesive. Suitable adhesives may exhibit high temperature resistance, such as silicate glue. The adhesive layer may be arranged between the at least one layer of ceramic paper and the combustible heat source and may attach the at least one layer of ceramic paper to the combustible heat source. The adhesive layer may be arranged between the at least one layer of ceramic paper and the one or more additional layers and may attach the at least one layer of ceramic paper to the one or more additional layers. The adhesive layer may be arranged between the at least one layer of ceramic paper and the aerosol-forming substrate and may attach the at least one layer of ceramic paper to the aerosol-forming substrate.

In some embodiments, the at least one layer of ceramic paper may be formed from a strip of ceramic paper having opposing ends. The strip of ceramic paper may be wrapped around the combustible heat source such that the opposing ends of the strip abut and do not overlap. An adhesive layer may be provided on the side of the strip facing the combustible heat source, at least at the opposing ends of the strip. The adhesive layer may secure the strip of ceramic paper to the combustible heat source, at least at the opposing ends of the strip.

The aerosol-generating article may comprise a heat conducting member arranged between the combustible heat source and the aerosol-forming substrate. The heat conducting member may be the first barrier, described above. The aerosol-generating article may comprise a heat conducting member and a first barrier. The heat conducting member may comprise similar material to the heat conducting element. The aerosol-generating article may comprise a heat conducting member and a heat conducting element. The provision of at least one of the heat-conducting element and the heat conducting member may facilitate conductive heat transfer between the combustible heat source and the aerosol-forming substrate.

The aerosol-generating article may further comprise any other suitable components. For example, the aerosol-generating article may comprise at least one of: a transfer element; an aerosol-cooling element; a spacer element; and a mouthpiece. The one or more further components may be arranged coaxially with the combustible heat source and the aerosol-forming substrate. The one or more further components may be arranged proximal to the aerosol-forming substrate. The one or more further components may be arranged in any suitable order. The aerosol-generating article may further comprise: a transfer element adjacent to the proximal end of the aerosol-forming substrate; an aerosol-cooling element adjacent to the proximal end of the transfer element; a spacer element adjacent to the proximal end of the aerosol-cooling element; and a mouthpiece adjacent to the proximal end of the spacer element.

As used herein the terms 'proximal' and 'distal' are used to describe the relative positions of components, or portions of components, of aerosol-generating articles according to invention. The proximal end of a component of the aerosol-generating article is the end of that component that is nearest the mouth end of the aerosol-generating article and the distal end of a component of the aerosol-generating article is the end of the component that is furthest from the mouth end of the aerosol-generating article. Typically the combustible heat source is arranged at the distal end of the aerosol-generating article.

According to a second aspect of the present invention, there is provided a method of forming an aerosol-generating article according to the first aspect of the present invention. The method comprises: arranging a combustible heat source to heat an aerosol-forming substrate; providing one or more airflow pathways along which air may be drawn through the aerosol-generating article for inhalation by a user, isolating the combustible heat source from the one or more airflow pathways such that, in use, air drawn through the aerosol-generating article along the one or more airflow pathways does not directly contact the combustible heat source; and circumscribing at least part of the length of the combustible heat source with at least one layer of ceramic paper.

In some embodiments, the step of circumscribing at least a portion of the length of the combustible heat source with at least one layer of ceramic paper may comprise: providing a strip of ceramic paper having opposing ends; wrapping the strip around the combustible heat source such that the combustible heat source is circumscribed by at least one layer of ceramic paper; overlapping the opposing ends of the strip; and securing together the overlapping ends to secure the at least one layer of ceramic paper to the combustible heat source.

The overlapping ends of the strip of ceramic paper may be secured together using any suitable means. For example, the overlapping ends of the strip of ceramic paper may be secured together using adhesive. Suitable adhesives should have high temperature resistance and include silica glue.

In some embodiments, the step of circumscribing at least a portion of the length of the combustible heat source with at least one layer of ceramic paper may comprise: providing a strip ceramic paper having opposing ends; applying an layer of adhesive to one side of the strip at least at each of the opposing ends; arranging the strip with the adhesive layer facing the combustible heat source; wrapping the strip around the combustible heat source such that at least a portion of the length of the combustible heat source is circumscribed by at least one layer of ceramic paper; abutting the opposing ends of the strip without overlapping the opposing ends; and securing the strip to the combustible heat source with the adhesive layer.

In some embodiments, the at least one layer of ceramic paper may be laminated with an additional layer, such as a layer of cigarette paper. The at least one layer of ceramic paper may be laminated with the additional layer before the at least one layer of ceramic paper is applied to the combustible heat source. A strip of the co-laminated paper comprising the at least one layer of ceramic paper and the additional layer may be wrapped around the combustible heat source in the same manner as the strip of ceramic paper. In some embodiments, the co-laminated paper may be arranged such that the at least one layer of ceramic paper faces the combustible heat source. In other words, the at least one layer of ceramic paper may be arranged radially inwards of the additional layer. In some embodiments, the co-laminated paper may be arranged such that the additional layer faces the combustible heat source.

The invention will be further described, by way of example only, with reference to the accompanying drawings in which.

Figure 1:
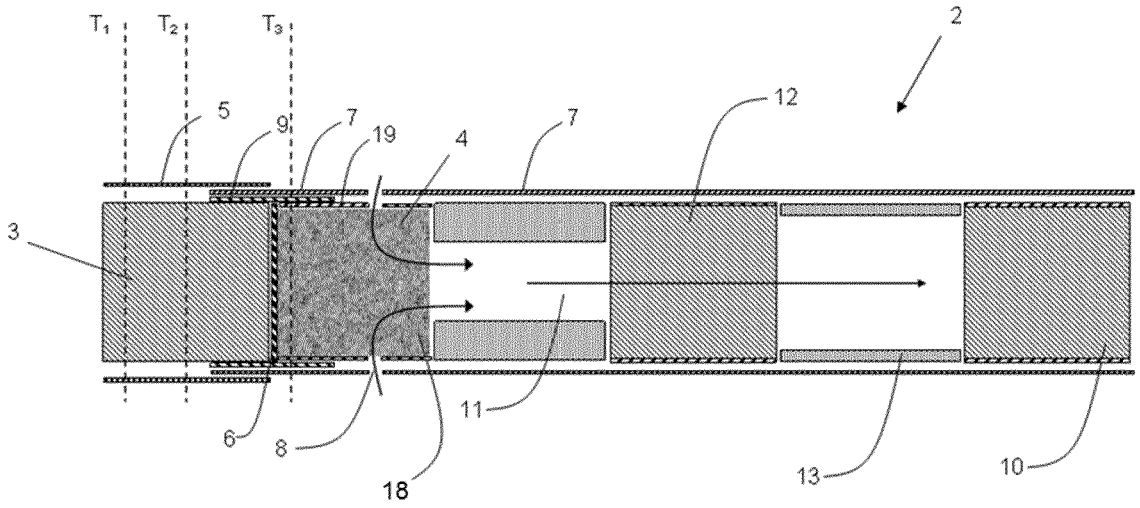
FIG. 1 shows a schematic representation of a first embodiment of an aerosol-generating article according to the present invention comprising a blind combustible heat source.

FIG. 1 shows a schematic representation of an aerosol-generating article 2. The aerosol-generating article 2 comprises a combustible heat source 3. The combustible heat source 3 comprises a substantially circularly cylindrical body of carbonaceous material, having a length of about 10 millimetres. The combustible heat source 3 is a blind heat source. In other words, the combustible heat source 3 does not comprise any air channels extending therethrough.

The aerosol-generating article 2 further comprises an aerosol-forming substrate 4. The aerosol-forming substrate 4 is arranged at a proximal end of the combustible heat source 3. The aerosol-forming substrate 4 comprises a substantially circularly cylindrical plug of tobacco material 18 circumscribed by filter plug wrap 19.

A non-combustible, substantially air impermeable first barrier 6 is arranged between the proximal end of the combustible heat source 3 and a distal end of the aerosol-forming substrate 4. The first barrier 6 comprises a disc of aluminium foil. The first barrier 6 also forms a heat-conducting member between the combustible heat source 3 and the aerosol-forming substrate 4, for conducting heat from the proximal face of the combustible heat source 3 to the distal face of the aerosol-forming substrate 4.

A heat-conducting element 9 circumscribes a proximal portion of the combustible heat source 3 and a distal portion of the aerosol-forming substrate 4. The heat-conducting element 9 comprises a tube of aluminium foil. The heat-conducting element 9 is in direct contact with the proximal portion of the combustible heat source 3 and the filter plug wrap 19 of the aerosol-forming substrate 4.

The aerosol-generating article 2 further comprises various other components arranged proximal to the aerosol-forming substrate 4, including: a transfer element 11 arranged at the proximal end of the aerosol-forming substrate 4; an aerosol-cooling element 12 arranged at the proximal end of the transfer element 11; a spacer element 13 arranged at the proximal end of the aerosol-cooling element 11; and a mouthpiece 10 arranged at a proximal end of the spacer element 13.

The components of the aerosol-generating article 2 are wrapped in a layer of cigarette paper 7. The layer of cigarette paper 7 circumscribes the heat conducting element 9, but does not extend beyond the distal end of the heat conducting element 9, over the distal portion of the combustible heat source 3.

In accordance with the present invention, the aerosol-generating article 2 further comprises a layer of ceramic paper 5. The layer of ceramic paper 5 circumscribes substantially the length of the combustible heat source 3 and a distal portion of the layer of cigarette paper 7, the heat-conducting element 9 and the aerosol-forming substrate 4. In other words, the layer of ceramic paper 5 is the radially outer layer at the distal end of the aerosol-generating article 2.

The layer of ceramic paper 5 comprises between about 60 percent by weight silica and about 70 percent by weight silica; between about 16 percent by weight calcium oxide and about 22 percent by weight calcium oxide and between about 12 percent by weight magnesium oxide and about 19 percent by weight magnesium oxide. The layer of ceramic paper 5 also comprises alumina and a binder material.

A plurality of air inlets 8 are arranged at the aerosol-forming substrate 4 to allow ambient air to be drawn into the aerosol-generating article 2. The air inlets 8 comprise a plurality of perforations through the layer of cigarette paper 7 and the underlying layer of plug wrap 19 that circumscribes the aerosol-forming substrate 4. The air inlets 8 are arranged between the distal face and the proximal face of the aerosol-forming substrate 4.

When a user draws on the mouthpiece 10 of the aerosol-generating article 2, ambient air may be drawn into the aerosol-generating article 2 through the air inlets 8. The air drawn into the aerosol-generating article 2 may flow along an airflow pathway of the aerosol-generating article 2, from the air inlets 8, through the aerosol-forming substrate 4, the transfer element 11, the cooling element 12 and the spacer element 13 to the mouthpiece 10, and out of the mouthpiece 10 to the user for inhalation. The general direction of the airflow through the aerosol-generating article 2 is indicated by the arrows.

In use, a user may ignite the combustible heat source 3 by exposing the combustible heat source 3 to an external heat source, such as a lighter. The combustible heat source 3 may ignite and combust and heat may be transferred from the combustible heat source 3 to the aerosol-forming substrate 4, via conduction through the heat-conducting member 6 and the heat-conducting element 9. Volatile components of the heated aerosol-forming substrate 4 may be vapourised. A user may draw on the mouthpiece 10 of the aerosol-generating article 2, drawing ambient air into the airflow pathway of the aerosol-generating article 2, through the air inlets 8. The vapour from the heated aerosol-forming substrate 4 may be entrained in the air drawn through the aerosol-forming substrate 4 and may be drawn with the air towards the mouthpiece 10. As the vapour is drawn towards the mouthpiece 10, the vapour may cool to form an aerosol. The aerosol may be drawn out of the mouthpiece 10 and be delivered to the user for inhalation.

It will be appreciated that the substantially air-impermeable first barrier 6 inhibits air being drawn through the combustible heat source 3 and into the aerosol-forming substrate 4. As such, the first barrier 6 substantially isolates the airflow pathway of the aerosol-generating article 2 from the combustible heat source 3.

In this embodiment, the layer of ceramic paper 5 extends over a minor portion of the distal end of the aerosol-forming substrate 4. As such, the layer of ceramic paper 5 is spaced from the air inlets 8. This spacing substantially isolates the layer of ceramic paper 5 from the air inlets 8, such that air drawn through the airflow pathway of the aerosol-generating article 2 does not come into contact with the layer of ceramic paper 5.

It will be appreciated that in some embodiments, the layer of ceramic paper may be in close proximity to the air inlets. In these embodiments, portions of the layer of ceramic paper that are in close proximity to the air inlets may be coated in a material substantially impermeable to fibres and particles. This may substantially isolate the portions of the layer of ceramic paper that are in close proximity to the air inlets, such that air drawn through the airflow pathway of the aerosol-generating article does not come into contact with the layer of ceramic paper.

Figure 2:
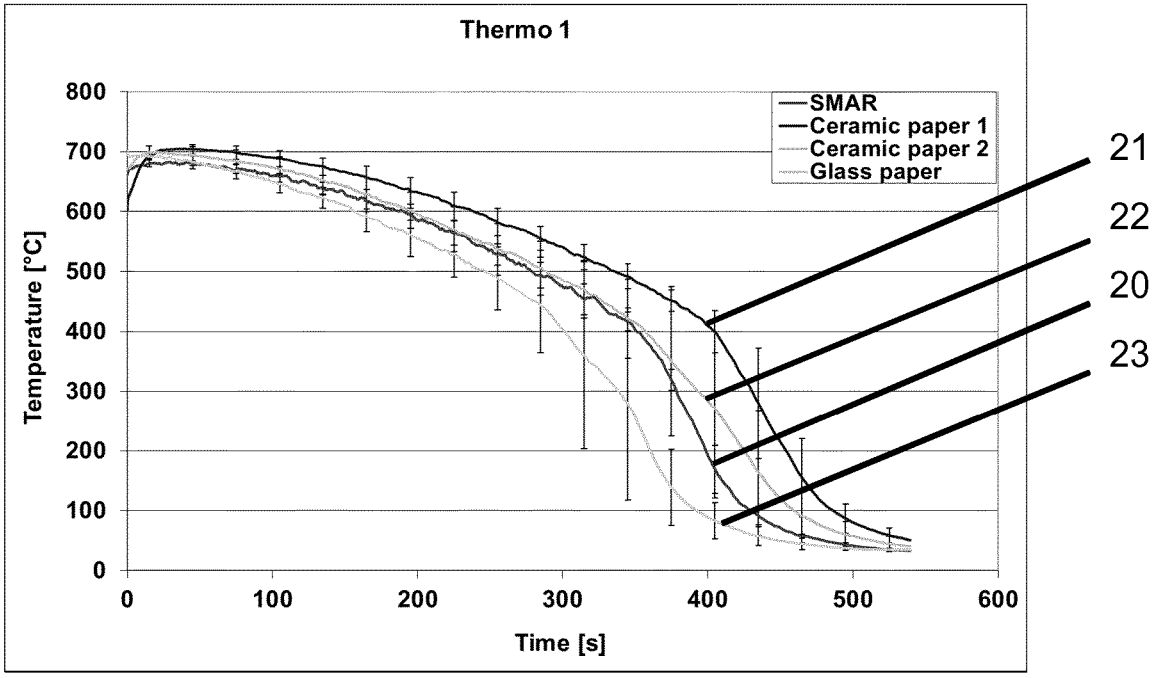
FIG. 2 shows the temperature profile of the aerosol-generating article of FIG. 1 at a first position.
Figure 3:
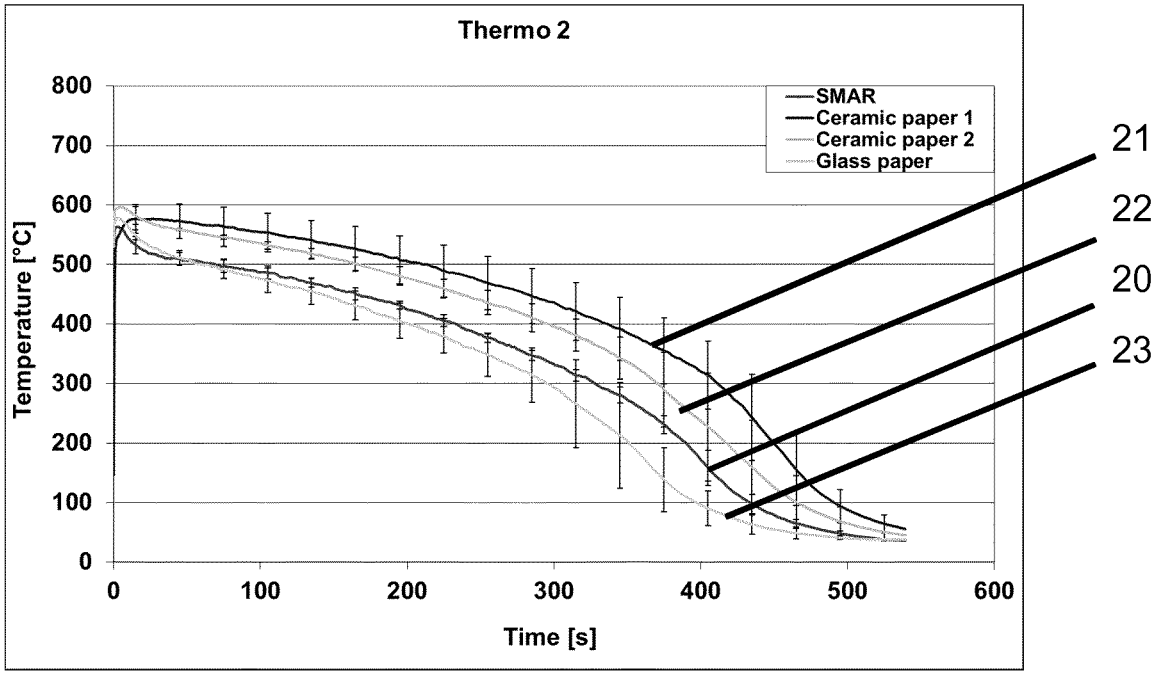
FIG. 3 shows the temperature profile of the aerosol-generating article of FIG. 1 at a second position.
Figure 4:
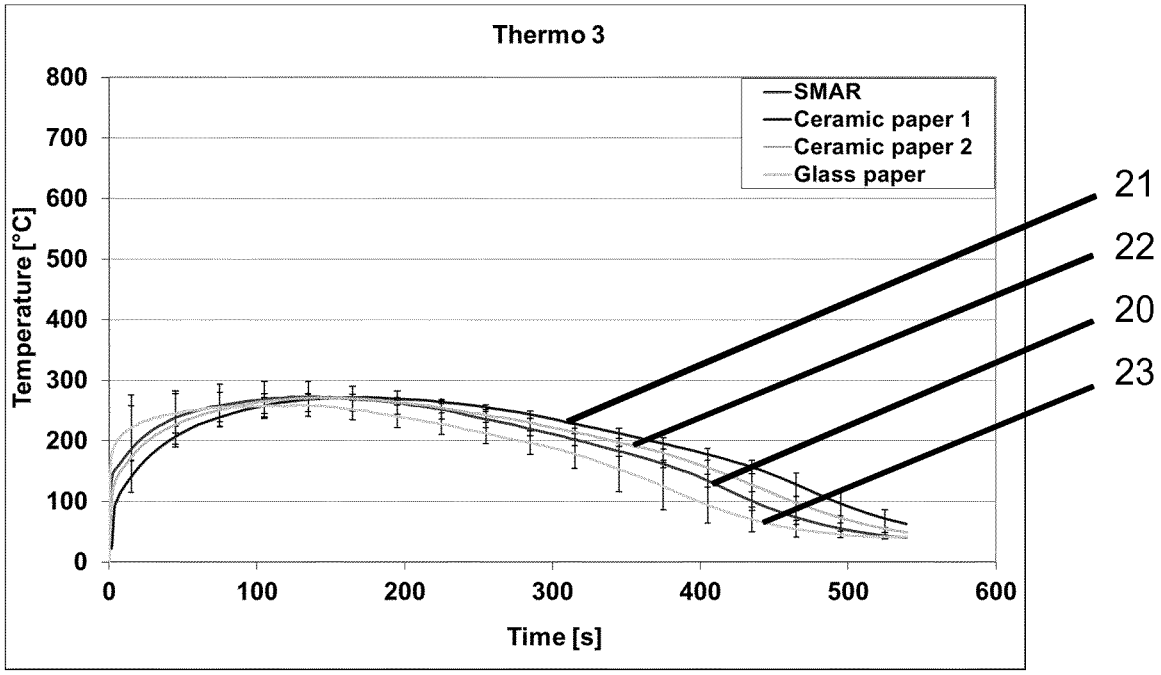
FIG. 4 shows the temperature profile of the aerosol-generating article of FIG. 1 at a third position.

Experimental data was collected to determine the temperature of combustible heat sources and aerosol-forming substrates of various aerosol-generating articles similar to the aerosol-generating article 2 shown in FIG. 1 over the period of combustion of the combustible heat source. Each of the aerosol-generating articles tested comprised a different layer of material circumscribing substantially the length of the combustible heat source. In particular, experimental data was collected for aerosol-generating articles comprising a layer of ceramic paper circumscribing substantially the length of the combustible heat source and no layer of material circumscribing substantially the length of the combustible heat source. FIGS. 2-4 show graphs of the experimental measurements of temperature over time at three different locations of the various aerosol-generating articles.

FIG. 2 shows the temperature measured at a position 2 millimetres from the distal end of the combustible heat source, which corresponds to position $T_1$ shown in FIG. 1. In other words, FIG. 2 shows the temperature at the distal end of the combustible heat source.

FIG. 3 shows the temperature measured at a position 5 millimetres from the distal end of the combustible heat source, which corresponds to position $T_2$ shown in FIG. 1. In other words, FIG. 3 shows the temperature approximately half way along the length of the combustible heat source.

FIG. 4 shows the temperature measured at a position 11 millimetres from the distal end of the combustible heat source, which corresponds to position 13 in FIG. 1. In other words, FIG. 4 shows the temperature at the distal end of the aerosol-forming substrate.

All of the temperature profiles were measured using electronic temperature probes that were inserted approximately 2 millimetres deep into the relevant components of the aerosol-generating articles.

In FIGS. 2, 3 and 4, the "SMAR" line, labelled as 20, shows the temperature profile of the aerosol-generating article with a "naked" combustible heat source. In other words, the "SMAR" line 22 shows the temperature profile of the aerosol-generating article with no layer of material circumscribing substantially the length of the combustible heat source.

In FIGS. 2, 3 and 4, the "ceramic paper 1" line, labelled as 21, shows the temperature profile of the aerosol-generating article with a layer of ceramic paper circumscribing substantially the length of the combustible heat source, in accordance with the present invention. The ceramic paper circumscribing substantially the length of the combustible heat source in the "ceramic paper 1" test was Superwool® Plus Fibre available from Morgan Advanced Materials, plc.

In FIGS. 2, 3 and 4, the "ceramic paper 2" line, labelled as 22, shows the temperature profile of the aerosol-generating article with a layer of ceramic paper circumscribing substantially the length of the combustible heat source, in accordance with the present invention. The ceramic paper circumscribing substantially the length of the combustible heat source in the "ceramic paper 2" test was CFP Ceramic Fibre Paper available from Ningbo Firewheel Thermal Insulation & Sealing Co., Ltd.

In FIGS. 2, 3 and 4, the "ceramic paper 2" line, labelled as 22, shows the temperature profile of the aerosol-generating article with a layer of ceramic paper circumscribing substantially the length of the combustible heat source, in accordance with the present invention. The ceramic paper circumscribing substantially the length of the combustible heat source in the "ceramic paper 2" test was CFP Ceramic Fibre Paper available from Ningbo Firewheel Thermal Insulation & Sealing Co., Ltd.

In FIGS. 2, 3 and 4, the "glass paper" line, labelled as 23, shows the temperature profile of the aerosol-generating article with a layer of ceramic paper circumscribing substantially the length of the combustible heat source, in accordance with the present invention. The ceramic paper circumscribing substantially the length of the combustible heat source in the "glass paper" test was ceramic paper comprising glass fibres.

It is desirable for the aerosol-generating articles having a layer of material circumscribing substantially the length of the aerosol-generating article to exhibit temperatures profiles substantially similar to or exceeding the temperature profile 20 of the aerosol-generating article with the naked combustible heat source, with no layer of material circumscribing substantially the length of the combustible heat source. Where the combustible heat source exhibits a similar or greater temperature than the naked combustible heat source, this indicates that the layer of material circumscribing substantially the length of the combustible heat source does not substantially inhibit combustion of the combustible heat source.

Surprisingly, as shown in FIGS. 2, 3 and 4, the temperature profiles 21, 22, 23 of the aerosol-generating article having a layer of ceramic paper circumscribing substantially the length of the combustible heat source are substantially similar to the temperature profile 20 of the aerosol-generating article with no layer of material circumscribing substantially the length of the combustible heat source at all three tested locations of the aerosol-generating article for the majority of the combustion time of the combustible heat source. Moreover, the temperature profiles 21 and 22 of the aerosol-generating article having a layer of ceramic paper circumscribing substantially the length of the combustible heat source actually exceeds the temperature profile 20 of the aerosol-generating article with no layer of material circumscribing substantially the length of the combustible heat source for some periods of time during the aerosol-generating experience.

This surprising result indicates that providing at least one layer of ceramic paper circumscribing substantially the length of the combustible heat source advantageously does not substantially impede combustion of the combustible heat source. In fact, providing the layer of ceramic paper may increase the temperature of the combustible heat source for periods of time during combustion of the combustible heat source.

Aerosol-generating articles according to the invention were also tested by observing their effect from placing them on Whatmann papers after the heat source was ignited. For example, the aerosol-generating articles were conditioned for 24 hours at about 23° C.±3° C. and 55%±5% relative humidity. The conditioned aerosol-generating articles were lit, using an electric lighter, and left to combust for a period of 2 minutes. After 2 minutes, the aerosol-generating articles were placed on a stack of Whatmann papers for a period of 10 minutes. After 10 minutes the Whatmann papers were inspected It was observed that the aerosol-generating article having the layer of ceramic paper circumscribing substantially the length of the combustible heat source did not produce a hole in any of the Whatmann papers and produced a small area of browning in the top paper. This result shows that having the layer of ceramic paper circumscribing substantially the length of the combustible heat source reduces the surface temperature proximate to the heat source.

Figure 5:
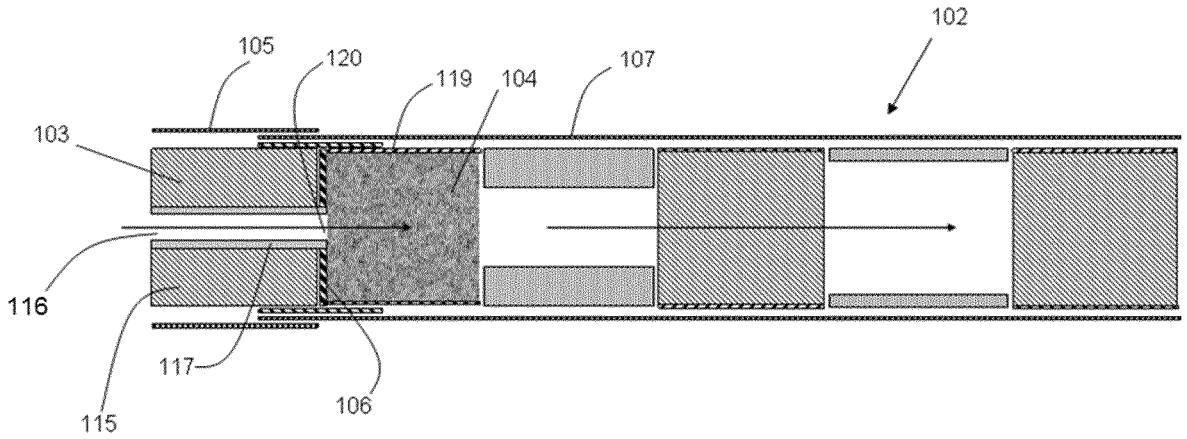
FIG. 5 shows a schematic representation of a second embodiment of an aerosol-generating article according to the present invention comprising a non-blind combustible heat source.

A schematic representation of a second embodiment of an aerosol-generating article according to the present invention is shown in FIG. 5. The aerosol-generating article 102 is substantially similar to the aerosol-generating article 2 shown in FIG. 1. The aerosol-generating article 102 comprises a combustible heat source 103, an aerosol-forming substrate 104, a layer of ceramic paper 105 and a layer of cigarette paper 107 arranged similarly to the corresponding components of the aerosol-generating article 2 shown in FIG. 1. However, combustible heat source 103 is a non-blind heat source. The non-blind heat source 103 comprises an annular body 115 of carbonaceous material having a passage 116 extending between the distal end face and the proximal end face. The passage 116 forms part of the airflow pathway through the aerosol-generating article and enables air to be drawn from the proximal end of the aerosol-generating article, through the combustible heat source 103, and to the aerosol-forming substrate 104. The layer of ceramic paper 105 is spaced from the airflow pathway through the aerosol-generating article 102 such that air drawn through the airflow pathway does not come into contact with the layer of ceramic paper 105.

A non-combustible, substantially air impermeable, first barrier 106 is arranged between the proximal end of the combustible heat source 103 and the distal end of the aerosol-forming substrate 104, similar to the first barrier 6 described above in relation to FIG. 1. However, unlike the first barrier 6 described above, the first barrier 106 includes an aperture 120, aligned with the passage 116, to enable air to pass from the passage 116 to the aerosol-forming substrate 104. A non-combustible, substantially air impermeable, second barrier 117 is coated on the inner surface of the passage 116. The second barrier 117 isolates air passing through the passage 116 from the combustible heat source 103 and from the products of combustion of the combustible heat source.

Since the combustible heat source 103 is a non-blind heat source, the aerosol-generating article 102 does not comprise air inlets arranged at the aerosol-forming substrate 104. When a user draws on the mouthpiece of the aerosol-generating article 102, ambient air may be drawn into the aerosol-generating article 102 through the passage 116 through the heat source 103. The air drawn into the aerosol-generating article 102 may flow along an airflow pathway of the aerosol-generating article 102, through the passage 116, through the aerosol-forming substrate 104, the transfer element, the cooling element and the spacer element to the mouthpiece, and out of the mouthpiece to the user for inhalation. The general direction of the airflow through the aerosol-generating article 102 is indicated by the arrows.

It will be appreciated that in some embodiments other air inlets may also be provided in the aerosol-generating article, in addition to the air passage through the combustible heat source. The specific embodiments described above are intended to illustrate the invention.

However, other embodiments may be made without departing from the scope of the invention as defined in the claims, and it is understood that the specific embodiments described above are not intended to be limiting.

The invention claimed is:

1. An aerosol-generating article, comprising:

an aerosol-forming substrate;

a combustible heat source;

at least one layer of ceramic paper circumscribing at least a portion of a length of the combustible heat source, wherein the at least one layer of ceramic paper allows sufficient air through the layer such that combustion of the combustible heat source is substantially unimpeded;

one or more airflow pathways along which air may be drawn through the aerosol-generating article for inhalation; and one or more non-combustible, substantially air impermeable barriers between the combustible heat source and the aerosol-forming substrate.

2. The aerosol-generating article according to claim 1, wherein the at least one layer of ceramic paper is isolated from the one or more airflow pathways such that air drawn through the aerosol-generating article along the one or more airflow pathways does not directly contact the at least one layer of ceramic paper.

3. The aerosol-generating article according claim 1, wherein the combustible heat source, the aerosol-forming substrate, and the at least one layer of ceramic paper are arranged such that a temperature of the aerosol-forming substrate does not exceed 375° C. during combustion of the combustible heat source.

4. The aerosol-generating article according to claim 1, wherein the ceramic paper comprises between about 50 percent by weight ceramic material and about 100 percent by weight ceramic material.

5. The aerosol-generating article according to claim 1, wherein the ceramic paper comprises silica fibres.

6. The aerosol-generating article according to claim 1, wherein the at least one layer of ceramic paper has a thickness of between about 0.5 mm and about 5 mm.

7. The aerosol-generating article according to claim 1, wherein the one or more non-combustible, substantially air impermeable barriers between the combustible heat source and the aerosol-forming substrate comprises a first barrier that abuts one or both of a proximal end of the combustible heat source and a distal end of the aerosol-forming substrate.

8. The aerosol-generating article according to claim 1, wherein the one or more airflow pathways comprise one or more air inlets arranged between a proximal end of the combustible heat source and a proximal end of the aerosol-generating article such that air may be drawn into the one or more airflow pathways of the aerosol-generating article though the one or more air inlets, without passing through the combustible heat source.

9. The aerosol-generating article according to claim 1, wherein the one or more airflow pathways comprise one or more airflow channels along the combustible heat source and the non-combustible, substantially air impermeable, barrier between the combustible heat source and the one or more airflow channels further comprises a second barrier between the combustible heat source and the one or more airflow channels of the combustible heat source.

10. The aerosol-generating article according to claim 1, wherein the aerosol-generating article further comprises one or more additional layers circumscribing at least a proximal portion of the combustible heat source and a distal portion of the aerosol-forming substrate, the one or more additional layers comprising:

a heat-conducting element to transfer heat from the combustible heat source to the aerosol-forming substrate, or a layer of cigarette paper, or both of the heat-conducting element to transfer heat from the combustible heat source to the aerosol-forming substrate, and the layer of cigarette paper.

11. The aerosol-generating article according to claim 10, wherein the at least one layer of ceramic paper is a radially outer layer, overlying at least a portion of the one or more additional layers.

12. The aerosol-generating article according to claim 1, wherein the at least one layer of ceramic paper has a permeability to air of greater than about 4,000 $cm^3/(min*cm^2)$.

13. The aerosol-generating article according to claim 1, wherein the at least one layer of ceramic paper has a thermal conductivity of between about 0.5 W/mK to 2 W/mK at a temperature of about 23° C.

14. The aerosol-generating article according to claim 1, wherein the at least one layer of ceramic paper circumscribes an upstream end of the combustible heat source.

15. The aerosol-generating article according to claim 1, wherein the at least one layer of ceramic paper is a wrapper.

16. The aerosol-generating article according to claim 1, wherein the at least one layer of ceramic paper is in direct contact with the combustible heat source.

* * * * *